US010495408B2

(12) United States Patent
Moore

(10) Patent No.: US 10,495,408 B2
(45) Date of Patent: Dec. 3, 2019

(54) LUMINESCENT ELEMENT RENEWAL SYSTEM

(71) Applicant: North Pass, Ltd., Laramie, WY (US)

(72) Inventor: Richard Alan Moore, Fort Collins, CO (US)

(73) Assignee: HiViz LLC, Laramie, WY (US)

( * ) Notice: Subject to any disclaimer, the term of this patent is extended or adjusted under 35 U.S.C. 154(b) by 456 days.

(21) Appl. No.: 15/244,256

(22) Filed: Aug. 23, 2016

(65) Prior Publication Data

US 2018/0058809 A1 Mar. 1, 2018

(51) Int. Cl.

| | |
|---|---|
| ***F41C 33/02*** | (2006.01) |
| ***H05B 37/02*** | (2006.01) |
| ***F41G 1/34*** | (2006.01) |

(52) U.S. Cl.

CPC ..... *F41C 33/029* (2013.01); *F41G 1/345* (2013.01); *H05B 37/0281* (2013.01)

(58) Field of Classification Search

CPC ..... F41C 33/029; F21V 23/001; F21V 23/02; F21V 23/04; F41G 1/02; F41G 1/06; F41G 1/345

See application file for complete search history.

(56) References Cited

U.S. PATENT DOCUMENTS

| | | | | |
|---|---|---|---|---|
| 5,263,209 | A * | 11/1993 | Pattee | A47K 13/24 362/101 |
| 5,671,539 | A * | 9/1997 | Barone | F41C 33/0218 362/110 |
| 6,364,498 | B1 * | 4/2002 | Burbank | G09F 13/20 362/260 |
| 8,403,517 | B1 * | 3/2013 | Cox | A63B 43/06 362/154 |
| 8,635,800 | B2 * | 1/2014 | Glimpse | F41G 1/02 42/131 |
| 8,635,801 | B2 * | 1/2014 | Glimpse | F41G 1/02 42/131 |
| 9,463,738 | B2 * | 10/2016 | Salter | B60R 22/12 |
| 9,539,942 | B2 * | 1/2017 | Salter | H05B 37/0227 |
| 9,840,193 | B1 * | 12/2017 | Chea | B60Q 3/217 |
| 9,931,991 | B2 * | 4/2018 | Huelke | B60R 7/10 |
| 2011/0051414 | A1 * | 3/2011 | Bailey | F21V 3/00 362/235 |
| 2014/0065442 | A1 * | 3/2014 | Kingsley | C09K 11/7792 428/690 |
| 2015/0138806 | A1 * | 5/2015 | Salter | B60Q 3/68 362/510 |

* cited by examiner

*Primary Examiner* — Anabel Ton
(74) *Attorney, Agent, or Firm* — Craig R. Miles; CR Miles P.C.

(57) ABSTRACT

A luminescent element renewal system including an enclosure having a closed condition defining an inside space in which one or more light emitting elements have a location to proximally align with a corresponding one or more photoluminescent elements of a device received within said enclosure with the one or more light emitting elements operable in the closed condition of the enclosure to emit an amount of light to induce luminescence in the photoluminescent elements of the device.

38 Claims, 6 Drawing Sheets

LUMINESCENT ELEMENT RENEWAL SYSTEM

I. FIELD OF THE INVENTION

A luminescent element renewal system including an enclosure having a closed condition defining an inside space in which one or more light emitting elements have a location to proximally align with a corresponding one or more photoluminescent elements of a device received within the enclosure with the one or more light emitting elements operable in the closed condition of the enclosure to emit an amount of light to induce luminescence in the photoluminescent elements of the device.

II. SUMMARY OF THE INVENTION

A broad object of the invention can be to provide a luminescent element renewal system, including an enclosure having a closed condition defining an inside space, one or more light emitting elements located in the enclosure to proximally align with a corresponding one or more photoluminescent elements of a device received within the enclosure, a power source capable of being electrically coupled to the one or more light emitting elements, and a switch operable in a closed condition of the enclosure to electrically couple the power source to the one or more light emitting elements and operable in an open condition of the enclosure to electrically uncouple the power source from the one or more light emitting elements.

Another broad object of the invention can be a method of making a luminescent element renewal system, including configuring an enclosure which has a closed condition defining an inside space, locating one or more light emitting elements in the enclosure to proximally align with a corresponding one or more photoluminescent elements of a device received within the enclosure, electrically coupling a power source to the one or more light emitting elements, and disposing a switch in the enclosure operable in the closed condition of the enclosure to electrically couple the power source to the one or more light emitting elements, and operable in the open condition to electrically uncouple the power source from the one or more light emitting elements.

Another broad object of the invention can be a method of using a luminescent element renewal system, including, obtaining an enclosure configured to have a closed condition defining an inside space in which one or more light emitting elements are located to proximally align with a corresponding one or more photoluminescent elements of a device received within the enclosure, and a switch operable in a closed condition of the enclosure to electrically couple a power source to the one or more light emitting elements, and operable in an open condition of the enclosure to electrically uncouple the power source from the one or more light emitting elements; disposing the enclosure in the open condition; positioning the device in the inside space with the photoluminescent elements proximally aligned with the light emitting elements, and disposing the enclosure in the closed condition, whereby the switch operates to electrically couple the power source to the one or more light emitting elements which emit an amount of light to induce luminescence in the photoluminescent elements of the device.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
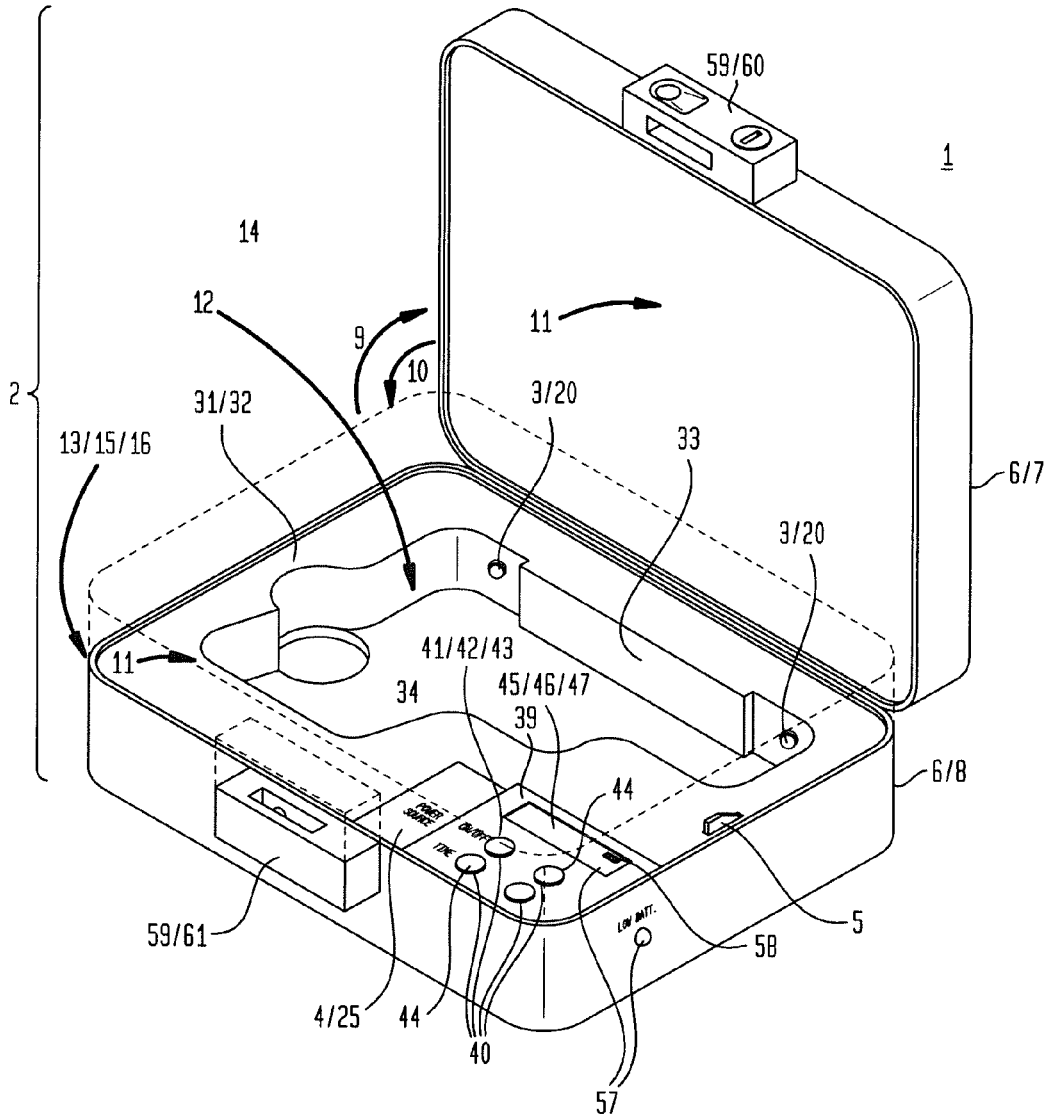
FIG. 1 is a perspective view of a particular embodiment of the luminescent element renewal system.

Referring primarily to FIGS. 1 through 8, particular embodiments of the luminescent element renewal system (1) can include one or more of an enclosure (2), light emitting element(s) (3), a power source (4), and a switch (5).

Figure 2:
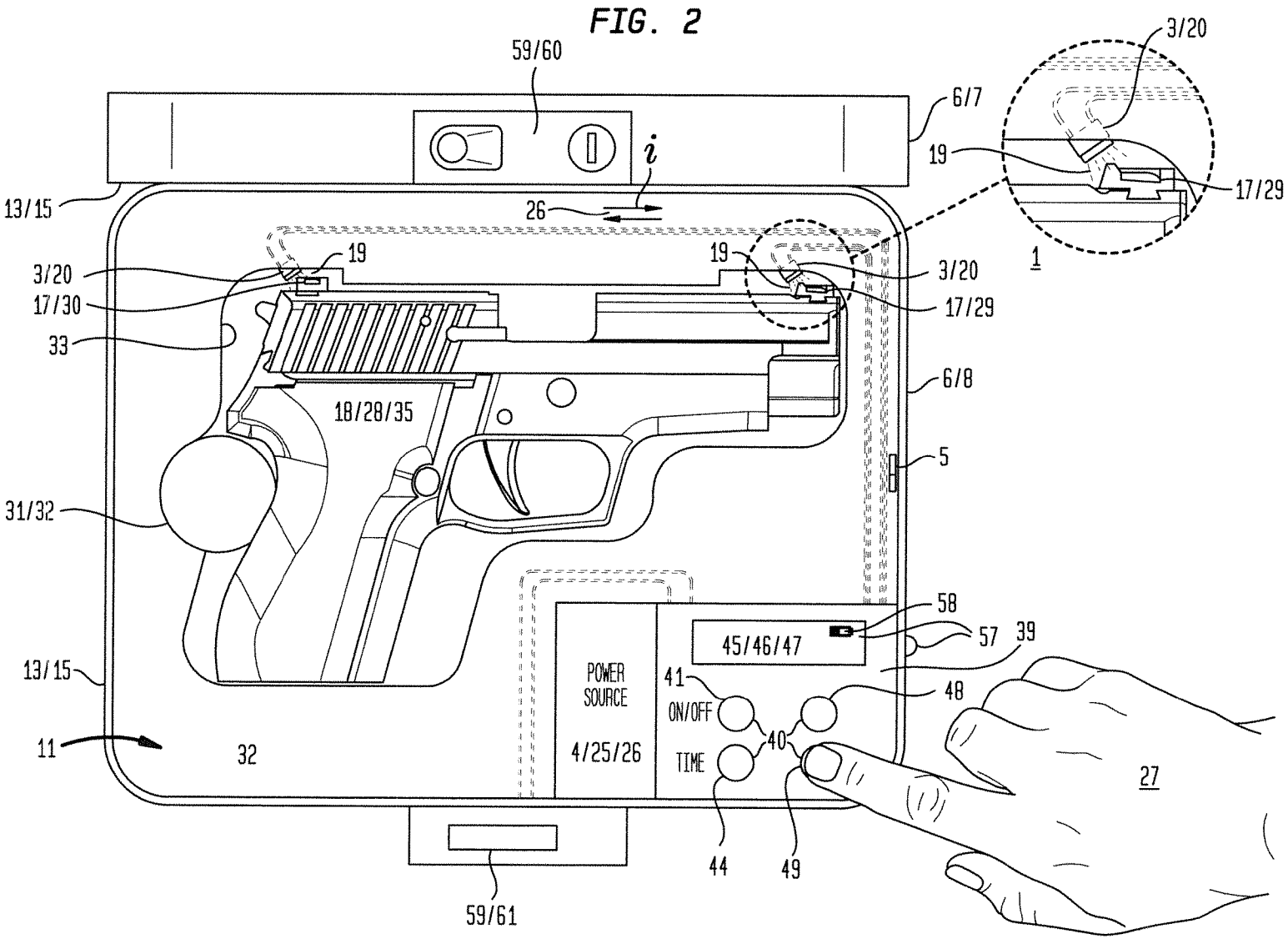
FIG. 2 is a top view of a particular embodiment of the luminescent element renewal system.
Figure 3:
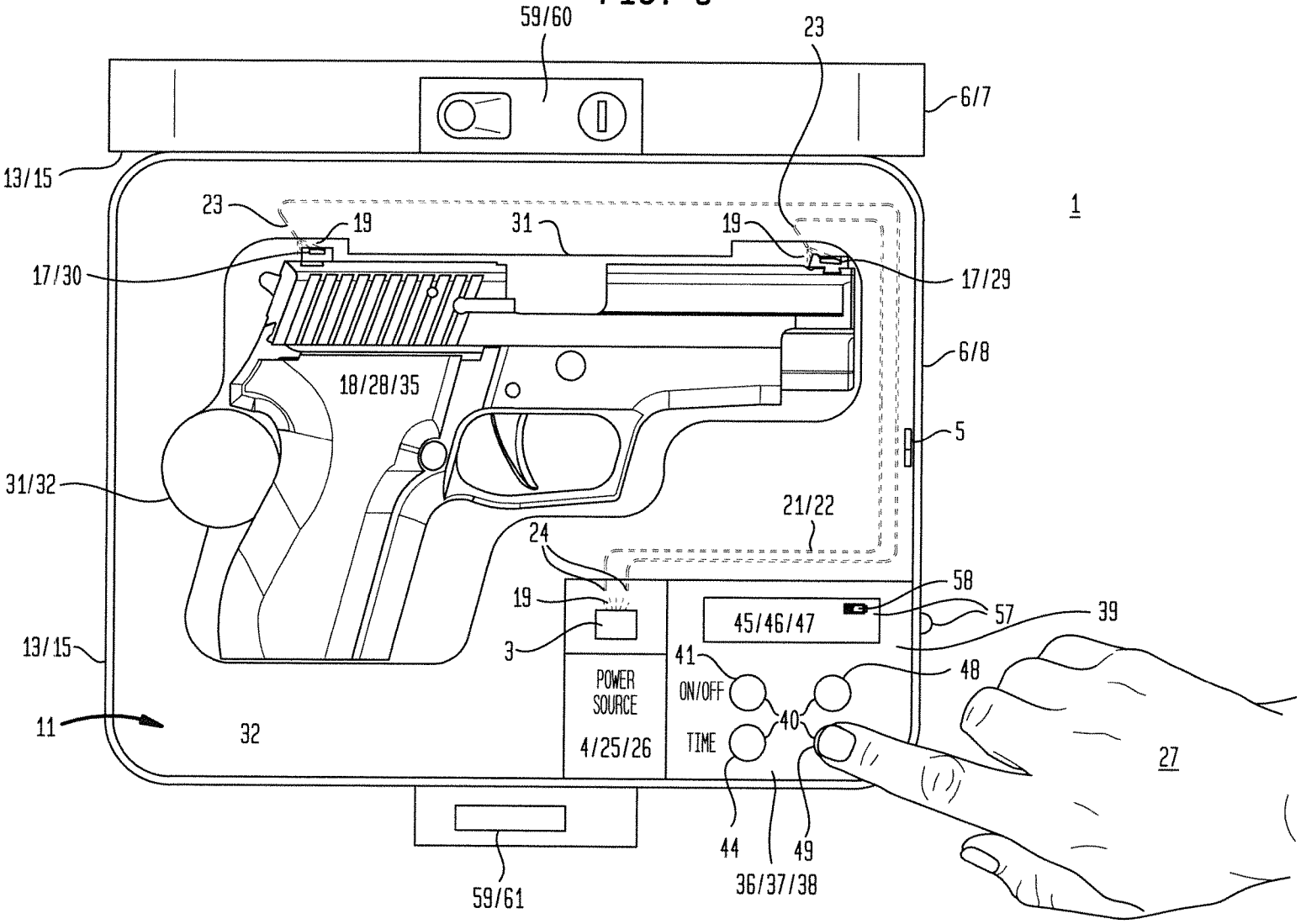
FIG. 3 is a top view of another particular embodiment of the luminescent element renewal system.

Now referring primarily to FIGS. 1 through 6, the enclosure (2) can, but need not necessarily, include one or more enclosure portions (6). As shown in the examples of FIGS. 1 through 3, particular embodiments of the enclosure (2) can include an enclosure first portion (7) and an enclosure second portion (8) configured to operate between an open condition (9) (as shown in the examples of FIG. 1 in solid line) and a closed condition (10) (as shown in the example of FIG. 1 in broken line). The closed condition (10) can be achieved by engaging the one or more enclosure portions (6) of the enclosure (2), so that the enclosure inner surface (11) defines an inside space (12). While the embodiment of the enclosure (2) shown in FIGS. 1 through 3 include an enclosure first portion (7) and an enclosure second portion (8) configured to releasably mateably engage at a common juncture plane (13) (or planes) to afford the closed condition (10), this is not intended to preclude embodiments including a greater or lesser number of enclosure portions (6). In the open condition (9), the inside space (12) can, in whole or in part, be exposed to the surrounding environment (14). In the closed condition (10), mateably engaged enclosure portions (6) can, but need not necessarily, afford a substantially light-tight juncture (15).

Embodiments of the enclosure (2) can be configured from any material which can afford an inner surface (11) configured to define an inside space (12) as above described, and as to particular embodiments can afford a light-tight juncture (15) or substantially light-tight juncture (15) to prevent or substantially prevent the passage of an amount of light (19) between the inside space (12) of the enclosure (2) to the surrounding environment (14) including, as illustrative examples: wood, metal, plastic, leather, fabric, or the like, or combinations thereof.

Figure 4:
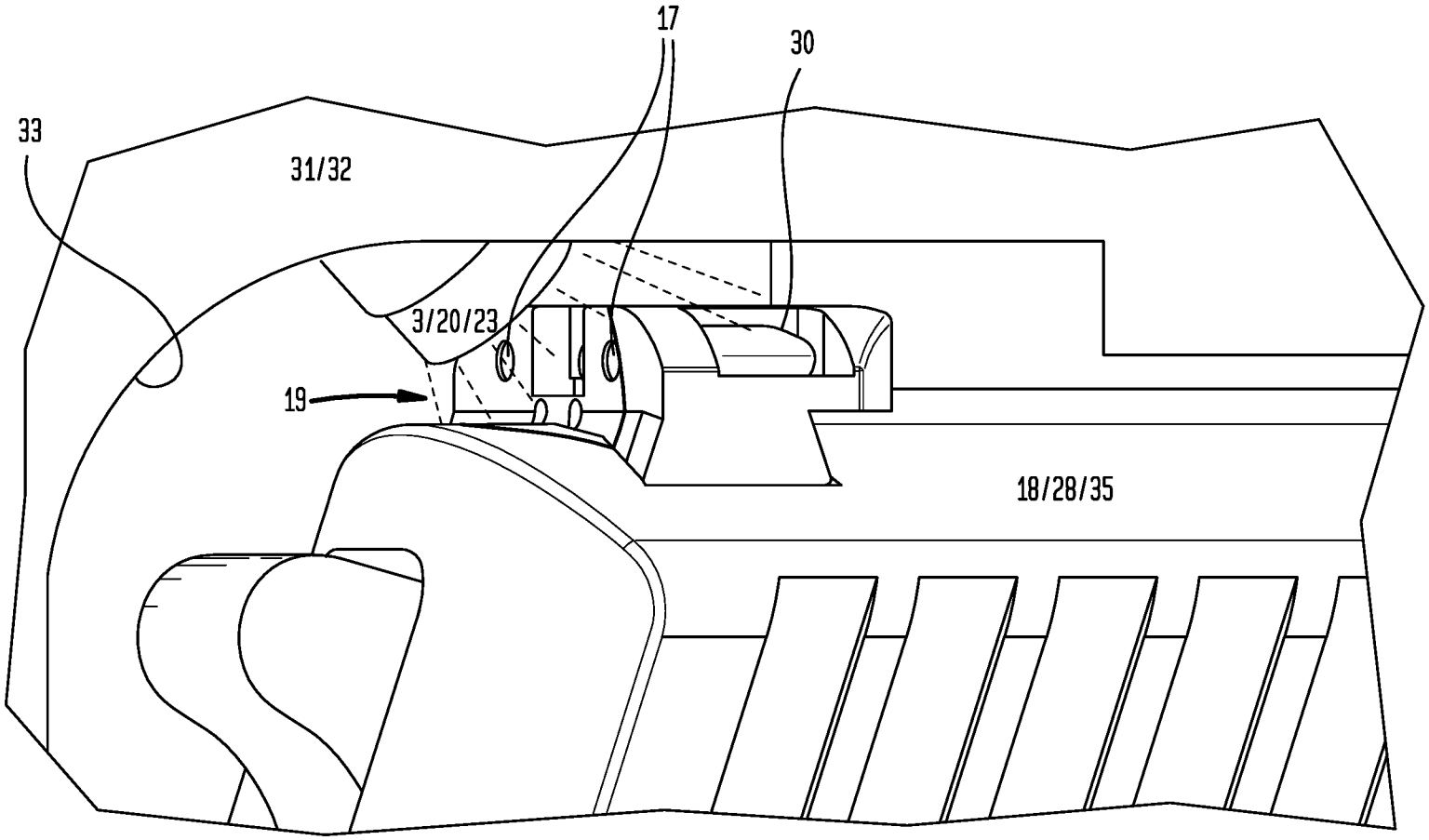
FIG. 4 is an enlarged view of a portion of the particular embodiments of the luminescent element renewal system shown in FIGS. 2 and 3.

Now primarily referring to FIGS. 2 through 4, particular embodiments of the luminescent element renewal system (1) can include one or more light emitting element(s) (3) located inside of the enclosure (2). The light emitting element(s) (3)

can be disposed inside of the enclosure (2) to proximally align with one or more corresponding photoluminescent elements (17) of a device (18)(or devices) received in the inside space (12) of the enclosure (2). The term "photoluminescent elements" for the purposes of this invention means elements which luminesce when induced by the absorption of radiation, and, without limitation to the breadth of the foregoing, fluorescence or phosphorescence induced by one or more of: infrared radiation, visible light, or ultraviolet radiation. The term "proximally aligned" for the purposes of this invention means disposing the one or more light emitting element(s) (3) and the photoluminescent elements (17) of a device (18) in spatial relation such that the photoluminescent elements (17) are wholly or partially exposed to an amount of light (19) emitted from the light emitting element(s) (3). By way of example, the light emitting element(s) (3) can be disposed in opposed relation, directly opposite, or abuttingly engaged with the photoluminescent elements (17) (as shown in the illustrative example of FIG. 3).

The light emitting element(s) (3) can be selected to emit an amount of light (19) having a wavelength or a combination of wavelengths in the ultraviolet, visible, and infrared ranges of the electromagnetic spectrum inclusive of about 10 nanometers ("nm") to about 1 millimeter ("mm"). The foregoing ranges can respectively include from about 1 mm to about 750 nm (infrared), about 750 nm to about 400 nm (visible), and about 400 nm to about 10 nm (ultraviolet). The wavelength(s) can be selected from the group including or consisting of: about 10 nm to about 50 nm, about 25 nm to about 75 nm, about 50 nm to about 100 nm, about 75 nm to about 125 nm, about 100 nm to about 150 nm, about 125 nm to about 175 nm, about 150 nm to about 200 nm, about 175 nm to about 225 nm, about 200 nm to about 250 nm, about 225 nm to about 275 nm, about 250 nm to about 300 nm, about 275 nm to about 325 nm, about 300 nm to about 350 nm, about 325 nm to about 375 nm, about 350 nm to about 400 nm, about 375 nm to about 425 nm, about 400 nm to about 450 nm, about 425 nm to about 475 nm, about 450 nm to about 500 nm, about 475 nm to about 525 nm, about 500 nm to about 550 nm, about 525 nm to about 575 nm, about 550 nm to about 600 nm, about 575 nm to about 625 nm, about 600 nm to about 650 nm, about 625 nm to about 675 nm, about 650 nm to about 700 nm, about 675 nm to about 725 nm, about 700 nm to about 750 nm, about 725 nm to about 775 nm, about 750 nm to about 800 nm, about 775 nm to about 825 nm, about 800 nm to about 850 nm, about 825 nm to about 875 nm, about 850 nm to about 900 nm, about 875 nm to about 925 nm, about 900 nm to about 950 nm, about 925 nm to about 975 nm, and 950 nm to about 1000 nm, and combinations thereof.

As to particular embodiments, the light emitting element(s) (3) can, but need not necessarily, be one or more light emitting diodes (20) capable of emitting an amount of light (19). For illustrative purposes and by way of example, ultraviolet light emitting diodes (20) can emit an amount of light (19) at a wavelength of about 240 nm to about 360 nm, near-ultraviolet to green light emitting diodes (20) can emit light at a wavelength of about 395 nm to 530 nm, and yellow-green to red light emitting diodes (20) can emit light at a wavelength of 565 nm to 645 nm. However, these illustrative examples are not intended to preclude the use of light emitting element 9(*s*) (3) such as incandescent, fluorescent, or xenon lamps.

The light emitting element(s) (3) can emit an amount of light (19) sufficient to induce luminescence such as fluorescence or phosphorescence by the photoluminescent elements (17). Depending upon the light emitting element (3), the amount of light incident on the surface of the photoluminescent elements (17) can, but need not necessarily, be in the range of about 5 lux ("lx") to about 1000 lx for a time period of about 1 minute to about 240 minutes. To ascertain the luminance achieved by a particular photoluminescent element (17) in combination with a particular light emitting element (3), the luminance can be measured with a calibrated photometer (luminance measurement instrument) in milli candela per square meter (mcd/m2). Additionally, the luminance achieved by a particular photoluminescent element (17) in a particular embodiment of the luminescent element renewal system (1) can be compared, pursuant to ASTM E2073-10, to the luminance of the photoluminescent elements (17) measured at 10, 60, and 90 minutes in full darkness following previous light exposure by 1 foot-candle (10.8 lux) of fluorescent lighting for 60 minutes or compared, pursuant to German DIN 67510 Part 1, to the luminance of the photoluminescent elements (17) measured at 2, 10, 30, and 60 minutes in full darkness following previous light activation by 1000 lux (92.9 foot-candle) of xenon lighting for 5 minutes.

Now referring primarily to FIG. 3, particular embodiments can further include one or more light conducting members (21) having a length (22) disposed between a light emitting end (23) and a light receiving end (24). The light emitting end (23) can be located in the enclosure (2) to proximally align with the corresponding one or more photoluminescent elements (17) of the device (18) received within the enclosure (2). A light emitting element(s) (3) can be disposed adjacent to the light receiving end (24) of the light conducting member (21). The light emitting element(s) (3) can operate to emit an amount of light (19) incident to the light receiving end (24) of the light conducting member (21). The amount of light (19) received by the light receiving end (24) can be conducted to the light emitting end (23). The amount of light (19) can be emitted from the light emitting end (23) of the light conducting member (21) incident upon the photoluminescent elements (17) of the device (18). The term "proximally aligned" for the purposes of this embodiment of the invention means disposing the one or more light emitting ends (23) and the photoluminescent elements (17) of a device (18) in spatial relation such that the photoluminescent elements (17) are wholly or partially exposed to an amount of light (19) emitted from the one or more light emitting ends (23). By way of example, the one or more light emitting ends (23) can be disposed in opposed relation, directly opposite, or abuttingly engaged with the photoluminescent elements (17) (as shown in the illustrative example of FIG. 3).

Now referring primarily to FIGS. 1-3 and 5-8, embodiments can further include a power source (4) electrically coupled to the light emitting element(s) (3). The power source (4) can be any source of energy which can be converted into electricity, including as illustrative examples one or more of: an electric battery (25) such as an alkaline battery, lithium ion battery, nickel metal hydride battery or the like, alternating current ("AC") supply, or like along with the associated circuitry to convert the electrical power to voltage and amperes consistent with operation of the light emitting element(s) (3). The power source (4) can be located in the inside space (12) of the enclosure (2), outside of the enclosure (2), removably coupled to the enclosure (2) or otherwise configured to supply power to the light emitting element(s) (3).

Again referring to FIGS. 1 and 2, embodiments can, but need not necessarily, include a switch (5) operable to control the flow of electricity (26) from the power source (4) to the light emitting element(s) (3). In the open condition (9) of the enclosure (2) or upon disengaging the mated enclosure portions (6) of the enclosure (2), the switch (5) can operate to interrupt the flow of electricity (26) by uncoupling the power source (4) from the light emitting element(s) (3). In the closed condition (10) of the enclosure (2), the switch (5) can operate to permit the flow of electricity (26) by coupling the power source (4) to the light emitting element(s) (3).

There can be substantial advantage in a switch (5) operable to interrupt the flow of electricity (26) to the light emitting element(s) (3) upon movement of the enclosure (2) toward the open condition (9). In the open condition (9), with the switch (5) having interrupted the flow of electricity (26) to the light emitting element(s) (3), the user (27) can dispose a device (18) in the inside space (12) of the enclosure (2) with the light emitting element(s) (3) (or the light emitting end (23) of the light conducting member (21)) proximally aligned with the photoluminescent elements (17). In the closed condition (10), the switch (5) operates to permit the flow of electricity (26) to the light emitting element(s) (3), which directly, or at the emitting end of the light conducting member (21), emit an amount of light (19) to induce luminescence in the photoluminescent elements (17) of the device (18). In the absence of light or in low light conditions, whether at night or within an unlit space, opening the enclosure (2) with an emittance of an amount of light (19) from the light emitting element(s) (3) may temporarily render the user (27) unable to see or unable to use the device (18) received within the enclosure (2). As one example, the device (18) may be a weapon (28) (as shown in the illustrative examples of FIGS. 2 and 3 and 6 and 7), and the one or more photoluminescent elements (17) can be integrated into the front sight (29) or the rear sight (30) of the weapon (28) as an aid to aiming the weapon (28) in the absence of light or in low light conditions. If the user's (27) eyes are acclimated to the absence of light, or low light conditions, and the light emitting element(s) (3) emit light upon moving toward the open condition (9) of the enclosure (2), it may cause the user (27) to be unable to see or be unable to sight the weapon (28) using the photoluminescent elements (17).

Figure 6:
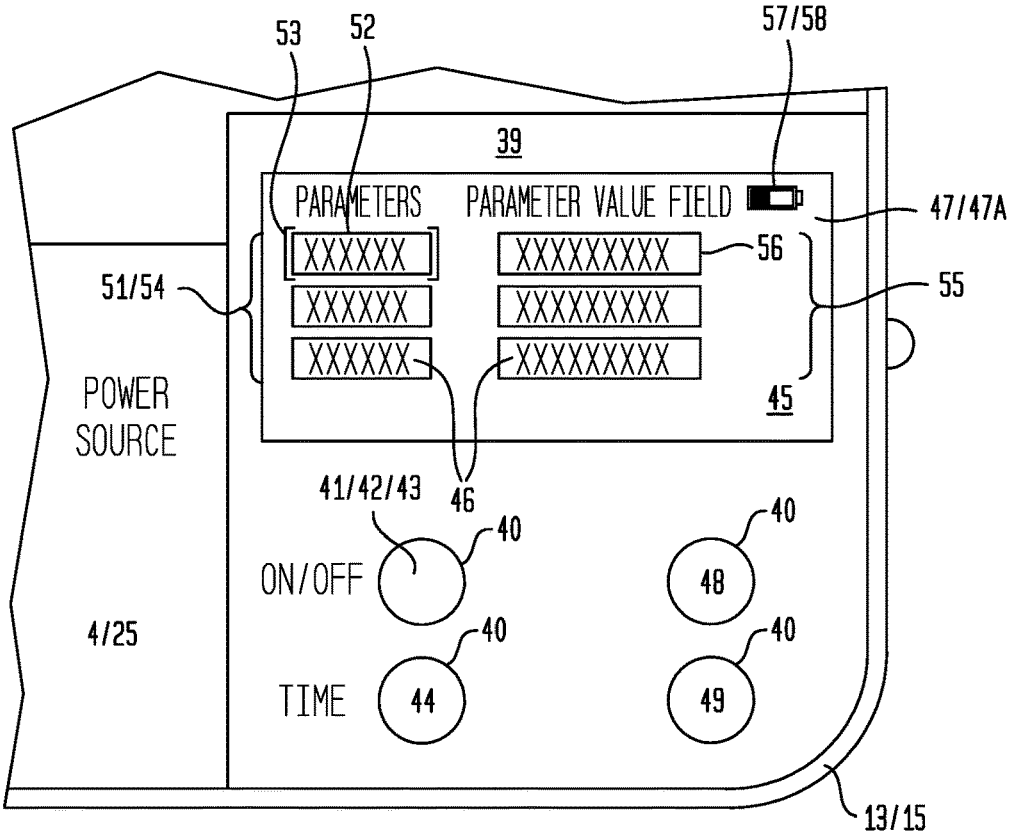
FIG. 6 is an enlarged view of a portion of FIG. 2 illustrating a particular embodiment of a user interface which allows programmable operation of the controller to couple and uncouple a power source from one or more light emitting elements.
Figure 8:
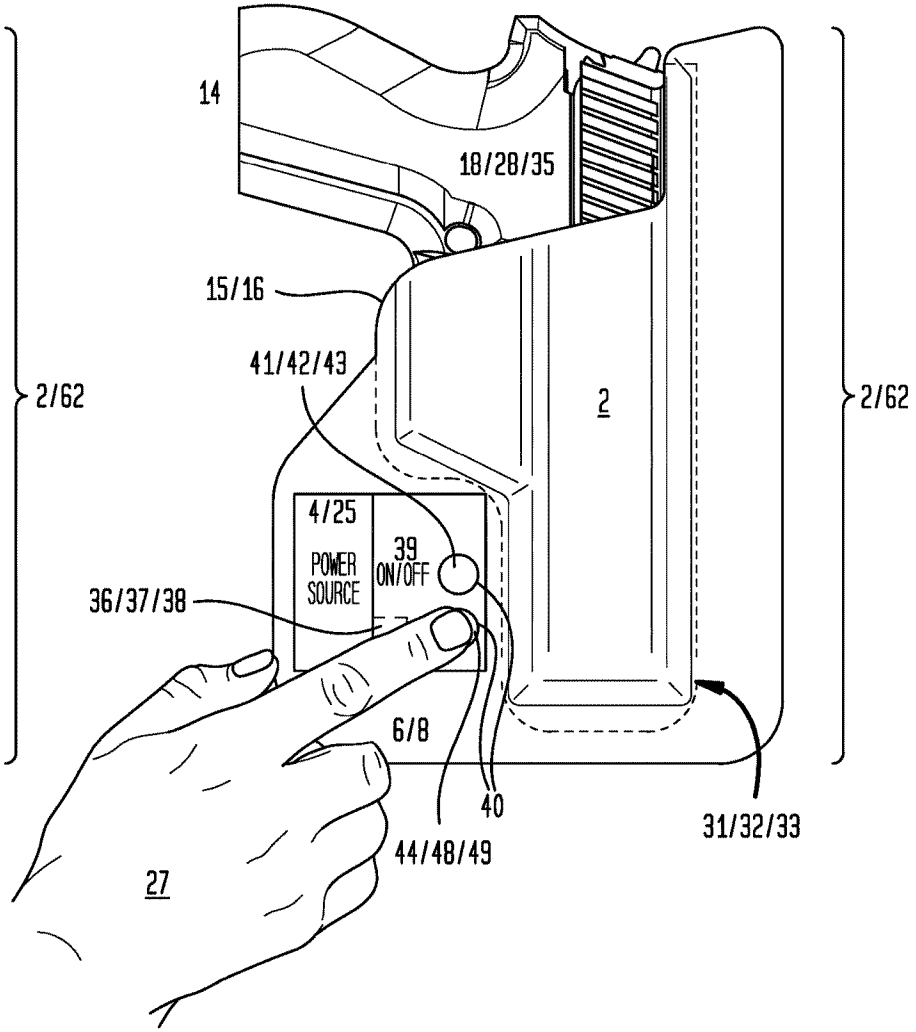
FIG. 8 is a top view of the particular embodiment of the luminescent element renewal system shown in FIG. 8.

Now primarily referring to FIGS. 1-2, and 6-7, particular embodiments of the luminescent element renewal system (1) can include one or more aligning elements (31) disposed in the enclosure (2). The aligning elements (31) can be configured to engage the device (18) being received within the enclosure (2) to assist in aligning one or more photoluminescent elements (17) of the device (18) with the one or more light emitting element(s) (3) located in the enclosure (2). As to particular embodiments, the aligning elements (31) can comprise a device retention body (32) having a cavity wall (33) defining a device receiving cavity (34). One or more light emitting element(s) (3) can be disposed in the cavity wall (33). The cavity wall (33) can be configured to engage the device (18) to dispose the light emitting element(s) (3) in fixed alignment with the one or more photoluminescent elements (17) of the device (18). It should be understood that, depending upon the configuration of the device (18), the device retention body (32) can include aligning elements (31) configured to the contour of such devices (18) to align the photoluminescent elements (17) of the device (18) with the light emitting element(s) (3). Additionally, the aligning elements (31) can take constructional forms other than a cavity wall (33), such as positional straps, contoured inserts, projecting tabs, or other modes which removably fix the positional orientation of a device (18) in the inside space (12) of the enclosure (2). As illustrated in FIGS. 1, 2 and 6, the cavity wall (33) of the device retention body (32) can be configured to receive a weapon (28) or firearm (35), and the light emitting element(s) (3) can be disposed in the cavity wall (33) to align with the photoluminescent elements (17) of the front sight (29) or the rear sight (30) of the weapon (28). The illustrative examples of FIGS. 2 and 6 are not intended to obviate embodiments of the invention which receive other configurations of weapon (28). The term "weapon" broadly encompass devices which can be aimed for military, sporting, hobby or other applications including, for example, guns, rifles, bows, shot guns, BB guns, pellet guns, or the like. Additionally, the invention can be utilized with other devices which are not encompassed by the definition of "weapon" such as cameras, recorders, lasers, or the like.

Figure 5:
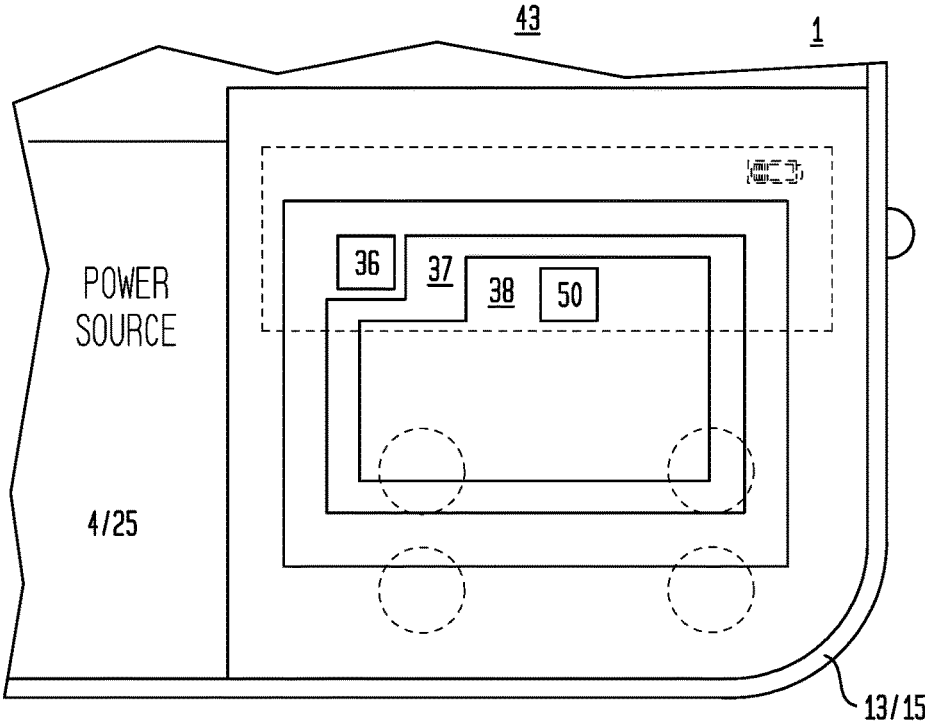
FIG. 5 is an enlarged view of a portion of FIG. 2 illustrating a particular embodiment having a controller including a processor communicatively coupled to a memory element containing a program executable to couple and uncouple a power source from one or more light emitting elements.

Now referring primarily to FIGS. 1 through 3, and 4 through 6 particular embodiments of the luminescent element renewal system (1) can, but need not necessarily include, a controller, including a processor (36) communicatively coupled to a memory element (37) containing a program (38) executable to control a switch (5) which electrically couples and uncouples the power source (4) to the one or more light emitting element(s) (3) between the open condition (9) and the closed condition (10) of the enclosure (2) (as shown in the example of FIG. 5). As to particular embodiments, the program (38) can be further executed to control the duration of time the power source (4) remains coupled or uncoupled to the one or more light emitting element(s) (3). In a particular embodiment, the program (38) can be executed to only couple the power source (4), only uncouple the power source (4), or alternate coupling and uncoupling the power source (4) to the one or more light emitting element(s) (3). In another particular embodiment, the program (38) can be executed to variably adjust the time duration that the power source (4) is electrically coupled or uncoupled to the one or more light emitting element(s) (3) and can couple the power source (4) to the light emitting element(s) (3) for a period of time greater than the period of time that the power source (4) is uncoupled from the light emitting element(s) (3), couple the power source (4) to the light emitting element(s) (3) for a period of time substantially equal to the period of time that the power source (4) is uncoupled from the light emitting element(s) (3), or couple the power source (4) to the light emitting element(s) (3) for a period of time less than the period of time that power source (4) is uncoupled from the light emitting element(s) (3).

As to particular embodiments, the program (38) can be executed to variably adjust the time duration that the power source (4) remains coupled to the light emitting element(s) (3) in a range of about 0 minutes to about 240 minutes. In particular embodiments, the time duration can be selected from the group including or consisting of: about 0 mins to about 10 mins, about 5 mins to about 15 mins, about 10 mins to about 20 mins, about 15 mins to about 25 mins. about 20 mins to about 30 mins, about 25 mins to about 35 mins, about 30 mins to about 40 mins. about 35 mins to about 45 mins. about 40 mins to about 50 mins. about 45 mins to about 55 mins, about 50 mins to about 60 mins, about 55 mins to about 65 mins, about 60 mins to about 70 mins, about 65 mins to about 75 mins, about 70 mins to about 80 mins, about 75 mins to about 85 mins, about 80 mins to about 90 mins, about 85 mins to about 95 mins, about 90 mins to about 100 mins, about 95 mins to about 105 mins, about 100 mins to about 110 mins, about 105 mins to about 115 mins, about 110 mins to about 120 mins, about 115 mins to about 125 mins, about 120 mins to about 130 mins, about 125 mins to about 135 mins, about 130 mins to about 140 mins, about 135 mins to about 145 mins, about 140 mins to about 150 mins, about 145 mins to about 155 mins, about 150 mins to about 160 mins, about 155 mins to about 165 mins, about 160 mins to about 170 mins, about 165 mins to about 175 mins, about 170 mins to about 180 mins. about 175 mins to about 185 mins, about 180 to about 190 mins. about 185 mins to about 195 mins, about 190 mins to about 200 mins, about 195 mins to about 205 mins, about 200 mins to about 210 mins, about 205 mins to about 215 mins, about 210 mins to about 220 mins, about 215 mins to about 225 mins, about 220 mins to about 230 mins, about 225 mins to about 235 mins, and about 230 mins to about 240 mins. Any combination of the above duration of time and coupling and uncoupling of the power source (4) to the one or more light emitting element(s) (3) can be executed by the program (38).

Referring primarily to FIGS. 1 through 3 and 6, embodiments can, but need not necessarily include, a user interface (39) communicatively coupled to the processor (36) and the memory element (37) containing the program (38). The user interface (39) includes user interface input elements (40) which allows the user (27) to execute various functions of the program (38) to control, re-program or monitor operation of the luminescent element renewal system (1). The user interface input elements (40) can be adapted to receive manual user inputs through one or more of sound, touch, or detected displacement, and without limitation to the breadth of the foregoing, user interface input elements (40) can be in the form of keys, buttons, touch screen, speech recognition hardware, or the like, or combinations thereof. As to particular embodiments, the user interface (39) can include a user interface input element (41) to initiate or terminate operation of the luminescent element renewal system (1) (as shown in the example of FIG. 6, an on/off button (41) can toggle between an on condition (42) and an off condition (43)).

As to particular embodiments, the user interface (39) can further include one or more additional user interface input elements (44) which allow the user (27) to select a time period between periods of operation of the switch (5) to electrically couple the power source (4) to the light emitting element(s) (3) for a duration of time as above described (as shown in the example of FIGS. 2 and 6, a time button (44) can be serially operable to select a duration of time between 1 hour and 24 hours between time periods in which the power source (4) remains uncoupled from the light emitting element(s) (3).

Again referring to FIGS. 4 and 5, embodiments of the user interface (39) can further include a display surface (45) adapted to display human readable indicia (46) to allow user (27) interaction in one or more menus (47) to allow selection of one or more time periods within a twenty-four hour time period in which the power source (4) remains coupled to the light emitting element(s) (3), and can further allow selection of the duration of time in each time period. Human readable indicia (46) may take the form of letters, numbers, symbols, shapes, colors, or the like or any combination thereof understandable by a human.

Now referring primarily to FIG. 6, as one illustrative example, the user interlace (39) can include a first user interlace navigation element (48) and a second user interface input navigation element (49) which execute a menu navigation module (50) or the program (38) (as shown in the example of FIG. 5). User (27) interaction with the first user interlace navigation element (48) and the second user interface navigation element (49) causes the navigation module (50) or the program (38) to retrieve and correspondingly serially display one or more menus (47) on the display surface (45). A first user (27) interaction with the first user interface navigation element (48) can cause the navigation module (50) to retrieve and display a first menu (47A) including one or more parameter control fields (51) each containing a control parameter (52). A menu cursor (53) can be positioned in one of the parameter control fields (51). One or more additional interactions with the first user interface navigation element (48) causes the navigation module (50) to serially advance the menu cursor (53) through the one or more parameter control fields (51) returnable to the parameter control field (51) in which the menu cursor (53) was originally positioned. As to particular embodiments, the one or more parameter control fields (51) can be displayed in a menu first column (54) each adjacent a corresponding parameter value Field (55) containing a parameter value (56). As an illustrative example, the parameter control fields (51) can include time duration between coupling the power source (4) to the light emitting element(s) (3), and the parameter value field (55) can be the selected time duration (56). The parameter control field (51) can further include the time duration the power source (4) remains coupled to the light emitting element(s) (3) and the parameter value field (55) can be the selected time duration.

As to particulars embodiments, the processor (36) can be coupled to a power indicator (57) to visibly show to the user (27) whether the luminescent element renewal system (1) is in operation. Further particular embodiments can include a power indicator (57) which visibly indicates to the user (27) by a sensorial perceivable indicia (58) the amount or power available to the luminescent element renewal system (1).

Now referring primarily to FIGS. 1-2, particular embodiments of the luminescent element renewal system (1) can include a locking element (59) which locks the enclosure (2) in a closed condition (10). In a particular embodiment, the locking element (59) can have a locking element first portion (60) disposed on the enclosure first portion (7) and a locking element second portion (61) disposed on the enclosure second portion (8). The locking element first portion (60) and locking element second portion (61) can be matingly engaged to lock the enclosure (2) in the closed condition (10). The locking element (59) can include as illustrative examples: a button strap, spring-loaded latch, a cylinder lock, a cam lock, t-handle lock, digital lock, smart lock, or other like locking mechanism for maintaining the closed condition (10) of the enclosure (2).

Figure 7:
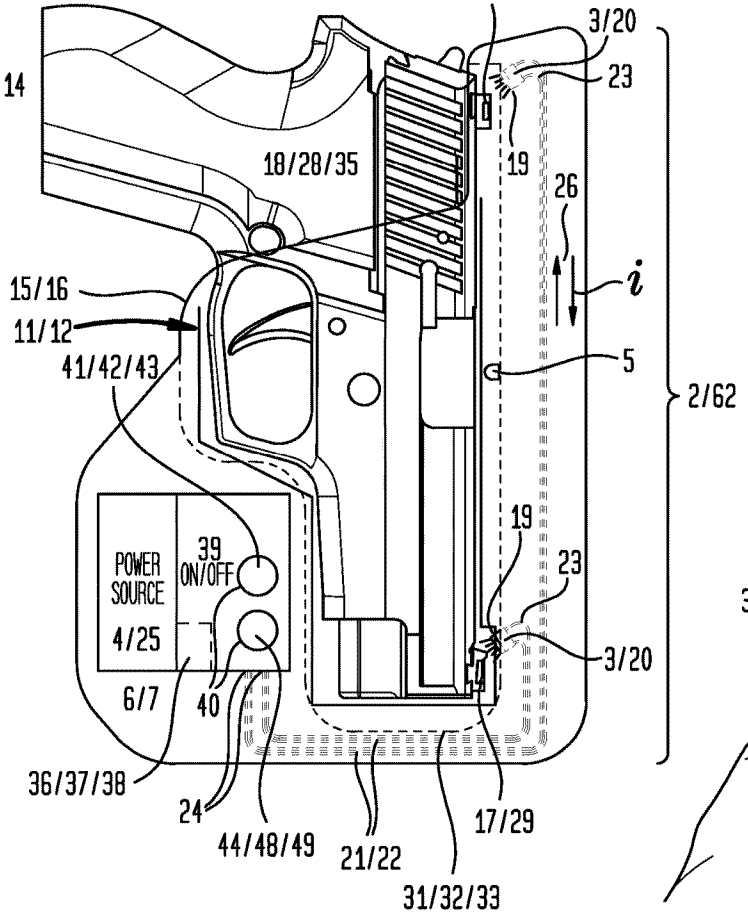
FIG. 7 is a bottom view of another particular embodiment of the luminescent element renewal system.

Now referring primarily to FIGS. 6 and 7, as to particular embodiments the enclosure (2) can be configured as a holster (62). The holster (62) can further include one or more of the elements above described to implement embodiments of the luminescent element renewal system (1). A firearm (35) including one or more photoluminescent elements (17) can be removably received in the inside space (12) of the holster (62). The holster (62) can proximally align the photoluminescent elements (17) with the corresponding light emitting element(s) (3) disposed in the holster (62). The light emitting elements (3) can emit sufficient amount of light (19) to induce the photoluminescent elements (17) to luminesce, as above described.

Particular embodiments of the luminescent element renewal system (1) can be utilized by first obtaining an enclosure (2) as described above, where the enclosure (2) comprises an enclosure (2), light emitting element(s) (3), a power source (4), and a switch (5); depositing a device (18) in the enclosure (2) so that the photoluminescent elements (17) of the device (18) proximally align with the one or more light emitting element(s) (3), and engaging the one or more portions of the enclosure (2) in a closed condition (10).

Further particular embodiments can include coupling a processor (36), which can further be coupled to a memory element (37) containing a program (38), to the power source (4) of the enclosure (2). The program (38) can then be executed to control the electrical coupling and uncoupling of the power source (4) to the one or more light emitting element(s) (3), according to a specific duration of time or irrespective of the duration of time. Particular embodiments can further couple a user interface (39) to the processor (36), where the user interface (39) can be used by the user (27) to initiate, terminate, or alter the program commands.

In particular embodiments, the utilization of the luminescent element renewal system (1) can also include depositing a locking element at or on the enclosure (2), as described previously, and further engaging the lock in the closed position of the enclosure (2).

As can be easily understood from the foregoing, the basic concepts of the present invention may be embodied in a variety of ways. The invention involves numerous and varied embodiments of a luminescent element renewal system and methods for making and using such luminescent element renewal systems including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "light emitting element" should be understood to encompass disclosure of the act of "emitting light"—whether explicitly discussed or not—and, conversely, were there effectively disclosure of the act of "emitting light", such a disclosure should be understood to encompass disclosure of a "light emitting element" and even a "means for emitting light." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about." it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the luminescent element renewal systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An enclosure, comprising:

an enclosure having a closed condition defining an inside space;

one or more light conducting members each having a length disposed between a light emitting end and a light receiving end, said light emitting end located in said enclosure to proximally align with a corresponding one or more photoluminescent elements of a device received within said enclosure;

one or more light emitting elements operable to emit an amount of light incident said light receiving end of said one or more light conducting members, said amount of light having a wavelength occurring in the range of about 10 nanometers to about 1 millimeter;

a power source electrically coupled to said one or more light emitting elements; and a switch which upon an open condition of said enclosure electrically uncouples said power source from said one or more light emitting elements.

2. The enclosure of claim 1, wherein said amount of light emitted by said one or more light emitting elements includes a wavelength occurring in a range of about 10 nm to about 2000 nm.

3. The enclosure of claim 2, wherein said wavelength of said amount of light occurring in said range of about 10 nm to about 2000 nm is selected from the group consisting of: about 20 nm to about 50 nm, about 25 nm to about 75 nm, about 50 nm to about 100 nm, about 75 nm to about 125 nm, about 100 nm to about 150 nm, about 125 nm to about 175 nm, about 150 nm to about 200 nm, about 175 nm to about 225 nm, about 200 nm to about 250 nm, about 225 nm to about 275 nm, about 250 nm to about 300 nm, about 275 nm to about 325 nm, about 300 nm to about 350 nm, about 325 nm to about 375 nm, about 350 nm to about 400 nm, about 375 nm to about 425 nm, about 400 nm to about 450 nm, about 425 nm to about 475 nm, about 450 nm to about 500 nm, about 475 nm to about 525 nm, about 500 nm to about 550 nm, about 525 nm to about 575 nm, about 550 nm to about 600 nm, about 575 nm to about 625 nm, about 600 nm to about 650 nm, about 625 nm to about 675 nm, about 650 nm to about 700 nm, about 675 nm to about 725 nm, about 700 nm to about 750 nm, about 725 nm to about 775 nm, about 750 nm to about 800 nm, about 775 nm to about 825 nm, about 800 nm to about 850 nm, about 825 nm to about 875 nm, about 850 nm to about 900 nm, about 875 nm to about 925 nm, about 900 nm to about 950 nm, about 925 nm to about 975 nm, about 950 nm to about 1000 nm, about 975 nm to about 1025 nm, about 1000 nm to about 1050 nm, about 1025 nm to about 1075 nm, about 1050 nm to about 1100 nm, about 1075 nm to about 1125 nm, about 1100 nm to about 1150 nm, about 1125 nm to about 1175 nm, about 1150 nm to about 1200 nm, about 1175 nm to about 1225 nm, about 1200 nm to about 1250 nm, about 1225 nm to about 1275 nm, about 1250 nm to about 1300 nm, about 1275 nm to about 1325 nm, about 1300 nm to about 1350 nm, about 1325 nm to about 1375 nm, about 1350 nm to about 1400 nm, about 1375 nm to about 1425 nm, about 1400 nm to about 1450 nm, about 1425 nm to about 1475 nm, about 1450 nm to about 1500 nm, about 1475 nm to about 1525 nm, about 1500 nm to about 1550 nm, about 1525 nm to about 1575 nm, about 1550 nm to about 1600 nm, about 1575 nm to about 1625 nm, about 1600 nm to about 1650 nm, about 1625 nm to about 1675 nm, about 1650 nm to about 1700 nm, about 1675 nm to about 1725 nm, about 1700 nm to about 1750 nm, about 1725 nm to about 1775 nm, about 1750 nm to about 1800 nm, about 1775 nm to about 1825 nm, about 1800 nm to about 1850 nm, about 1825 nm to about 1875 nm, about 1850 nm to about 1900 nm, about 1875 nm to about 1925 nm, about 1900 nm to about 1950 nm, about 1925 nm to about 1975 nm, and about 1950 nm to about 1990 nm, and combinations thereof.

4. The enclosure of claim 3, wherein said one or more light emitting elements comprise one or more light emitting diodes which emit said amount of light.

5. The enclosure of claim 1, further comprising one or more aligning elements disposed in said enclosure, said device received within said enclosure responsive to said one or more aligning elements to align said one or more photoluminescent elements of said device with said light receiving end of each of said one or more light conducting members located in said enclosure.

6. The enclosure of claim 5, wherein said one more aligning elements comprises a device retention body having a cavity wall, said one or more light conducting members disposed in said cavity wall, said device engagable in substantially fixed relation with said cavity wall to align said one or more photoluminescent elements of said device with said light receiving end of each of said one or more light conducting members located in said enclosure.

7. The enclosure of claim 6, further comprising a controller including a processor communicatively coupled to a memory element, said memory element containing a program executable to periodically electrically couple or uncouple said power source from said one or more light emitting diodes in the closed condition of said enclosure.

8. The enclosure of claim 7, wherein said program executable to electrically couple said power source to said one or more light emitting diodes for a time duration in the closed condition of said enclosure.

9. The enclosure of claim 8, wherein said program executable to electrically uncouple said power source from said one or more light emitting diodes for a time duration in the closed condition of said enclosure.

10. The enclosure of claim 9, wherein said program executable to alternately electrically couple said power source to said one or more light emitting diodes for said time duration and electrically uncouple said power source from said one or more light emitting diodes for said time duration.

11. The enclosure of claim 10, wherein said program executable to allow variable adjustment of said time duration, said time duration associated with said power source electrically coupled to said one or more light emitting diodes lesser than said time duration associated with said power source electrically uncoupled from said one or more light emitting diodes.

12. The enclosure of claim 11, wherein said program executable to allow variable adjustment of said time duration, said time duration associated with said power source electrically coupled to said one or more light emitting diodes substantially equal to said time duration associated with said power source electrically uncoupled from said one or more light emitting diodes.

13. The enclosure of claim 12, wherein said program executable to allow variable adjustment of said time duration, said time duration associated with said power source electrically coupled to said one or more light emitting diodes greater than said time duration associated with said power source electrically uncoupled from said one or more light emitting diodes.

14. The enclosure of claim 13, wherein said locking element further comprises a locking element first portion and a locking element second portion, said first portion locking element disposed on said first portion and said second portion locking element disposed on said second portion, said first portion locking element configured to matingly engage said second portion locking element.

15. The enclosure of claim 14, further comprising a user interface coupled to said controller, said user interface operably interactive with a user to program said controller.

16. A method, comprising:

obtaining an enclosure having a closed condition defining an inside space;

locating one or more light conducting members in said enclosure, each of said light conducting members having a length disposed between a light emitting end and a light receiving end, said light emitting end located in said enclosure to proximally align with a corresponding one or more photoluminescent elements of a device received within said enclosure;

disposing one or more light emitting elements operable to emit an amount of light incident said light receiving end of said one or more light conducting members, said amount of light including one or more wavelengths occurring in the range of about 10 nanometers to about 1 millimeter;

electrically coupling a power source to said one or more light emitting elements;

disposing a switch in said enclosure, said switch upon an open condition of said enclosure electrically uncouples said power source from said one or more light emitting elements.

17. The enclosure of claim 16, wherein said amount of light emitted by said one or more light emitting elements includes one or more wavelengths occurring in a range of about 10 nm to about 2000 nm.

18. The enclosure of claim 17, wherein said wavelength of said amount of light occurring in said range is selected from the group consisting of: about 20 nm to about 50 nm, about 25 nm to about 75 nm, about 50 nm to about 100 nm, about 75 nm to about 125 nm, about 100 nm to about 150 nm, about 125 nm to about 175 nm, about 150 nm to about 200 nm, about 175 nm to about 225 nm, about 200 nm to about 250 nm, about 225 nm to about 275 nm, about 250 nm to about 300 nm, about 275 nm to about 325 nm, about 300 nm to about 350 nm, about 325 nm to about 375 nm, about 350 nm to about 400 nm, about 375 nm to about 425 nm, about 400 nm to about 450 nm, about 425 nm to about 475 nm, about 450 nm to about 500 nm, about 475 nm to about 525 nm, about 500 nm to about 550 nm, about 525 nm to about 575 nm, about 550 nm to about 600 nm, about 575 nm to about 625 nm, about 600 nm to about 650 nm, about 625 nm to about 675 nm, about 650 nm to about 700 nm, about 675 nm to about 725 nm, about 700 nm to about 750 nm, about 725 nm to about 775 nm, about 750 nm to about 800 nm, about 775 nm to about 825 nm, about 800 nm to about 850 nm, about 825 nm to about 875 nm, about 850 nm to about 900 nm, about 875 nm to about 925 nm, about 900 nm to about 950 nm, about 925 nm to about 975 nm, about 950 nm to about 1000 nm, about 975 nm to about 1025 nm, about 1000 nm to about 1050 nm, about 1025 nm to about 1075 nm, about 1050 nm to about 1100 nm, about 1075 nm to about 1125 nm, about 1100 nm to about 1150 nm, about 1125 nm to about 1175 nm, about 1150 nm to about 1200 nm, about 1175 nm to about 1225 nm, about 1200 nm to about 1250 nm, about 1225 nm to about 1275 nm, about 1250 nm to about 1300 nm, about 1275 nm to about 1325 nm, about 1300 nm to about 1350 nm, about 1325 nm to about 1375 nm, about 1350 nm to about 1400 nm, about 1375 nm to about 1425 nm, about 1400 nm to about 1450 nm, about 1425 nm to about 1475 nm, about 1450 nm to about 1500 nm, about 1475 nm to about 1525 nm, about 1500 nm to about 1550 nm, about 1525 nm to about 1575 nm, about 1550 nm to about 1600 nm, about 1575 nm to about 1625 nm, about 1600 nm to about 1650 nm, about 1625 nm to about 1675 nm, about 1650 nm to about 1700 nm, about 1675 nm to about 1725 nm, about 1700 nm to about 1750 nm, about 1725 nm to about 1775 nm, about 1750 nm to about 1800 nm, about 1775 nm to about 1825 nm, about 1800 nm to about 1850 nm, about 1825 nm to about 1875 nm, about 1850 nm to about 1900 nm, about 1875 nm to about 1925 nm, about 1900 nm to about 1950 nm, about 1925 nm to about 1975 nm, and about 1950 nm to about 1990 nm, and combinations thereof.

19. The method of claim 18, wherein said one or more light emitting elements comprise one or more light emitting diodes.

20. The method of claim 16, further comprising disposing one or more aligning elements in said enclosure, said device received within said enclosures responsive to said one or more aligning elements to align said one or more photoluminescent elements of said device with said light receiving end of each of said one or more light conducting members located in said enclosure.

21. The method of claim 20, wherein said one or more aligning elements comprise a device retention body having a cavity wall, said one or more light conducting members disposed in said cavity wall, said device engageable in substantially fixed relation with said cavity wall to align said one or more photoluminescent elements of said device with said light receiving end of each of said one or more light conducting members located in said cavity wall.

22. The method of claim 21, further comprising coupling a controller to said one or more light emitting diodes, said controller having a processor communicatively coupled to a memory element containing a program executable to electrically couple or uncouple said power source from said one or more light emitting diodes.

23. The method of claim 22, wherein said program electrically couples said power source to said one or more light emitting diodes for a time duration in the closed condition of said enclosure.

24. The method of claim 23, wherein said program electrically uncouples said power source from said one or more light emitting diodes for a time duration during said closed condition of said enclosure.

25. The method of claim 24, wherein said program alternately electrically couples said power source to said one or more light emitting diodes for said time duration and electrically uncouples said power source from said one or more light emitting diodes for said time duration.

26. The method of claim 25, wherein said program allows variable adjustment of said time duration, said time duration associated with said power source electrically coupled to said one or more light emitting diodes lesser than said time duration associated with said power source electrically uncoupled from said one or more light emitting diodes.

27. The method of claim 26, wherein said program allows variable adjustment of said time duration, said time duration associated with said power source electrically coupled to said one or more light emitting diodes substantially equal to said time duration associated with said power source electrically uncoupled from said one or more light emitting diodes.

28. The method of claim 27, wherein said program allows variable adjustment of said time duration, said time duration associated with said power source electrically coupled to said one or more light emitting diodes greater than said time duration associated with said power source electrically uncoupled from said one or more light emitting diodes.

29. The method of claim 28, wherein said enclosure includes a first portion and a second portion and wherein said locking element includes a locking element first portion and a locking element second portion, said locking element first portion disposed on said first portion of said enclosure and said locking element second portion disposed on said second portion of said enclosure, said locking element first portion configured to matingly engage said locking element second portion in said closed condition of said enclosure.

30. A method of using an enclosure, comprising:

obtaining an enclosure, including:

an inner surface which in a closed condition of said enclosure defines an inside space;

one or more light emitting elements located in said enclosure to proximally align with a corresponding one or more photoluminescent elements of a device received within said enclosure;

a power source electrically coupled to said one or more light emitting elements; and a switch operable in an open condition of said enclosure to electrically uncouple said power source from said one or more light emitting elements;

disposing said enclosure in said open condition;

positioning said device in said inside space of said enclosure, wherein said one or more photoluminescent elements proximally align with said one or more light emitting elements;

disposing said enclosure in said closed condition, wherein said switch operates in said closed condition to electrically couple said power source to said one or more light emitting elements, said one or more light emitting elements emitting an amount of light to induce said photoluminescent elements to luminesce.

31. The method of claim 30, wherein said enclosure further comprises a controller including a processor communicatively coupled to a memory element containing a program, said controller coupled to a user interface, and further comprising adjusting a parameter control values in said program by user interaction with said user interface.

32. The method of claim 31, wherein said parameter control value comprises a time duration in which said switch operates to electrically couple said power source to said light emitting elements in the closed condition of said enclosure.

33. The method of claim 32, wherein said parameter control value comprises a time duration in which said switch operates to uncouple said power source from said one or more light emitting elements in the closed condition of said enclosure.

34. The method of claim 33, further comprising adjusting said time duration in which said switch operates to electrically couple said power source to said one or more light emitting elements to lesser than said time duration in which said switch operates to uncouple said power source from said one or more light emitting elements.

35. The method of claim 34, further comprising adjusting said time duration in which said switch operates to electrically couple said power source to said one or more light emitting elements to equal to said time duration in which said switch operates to uncouple said power source from said one or more light emitting elements.

36. The method of claim 35, further comprising adjusting said time duration in which said switch operates to electrically couple said power source to said one or more light emitting elements to greater than said time duration in which said switch operates to uncouple said power source from said one or more light emitting elements.

37. The method of claim 29, further comprising electrically coupling a user interface to said controller, said user interface operably interactive with a user to program said controller.

38. An enclosure, comprising:

an enclosure having a closed condition defining an inside space;

one or more light emitting elements located in said enclosure to proximally align with a corresponding one or more photoluminescent elements of a device received within said enclosure, said one or more light emitting elements emitting an amount of light including one or more wavelengths which occur in a range of about 10 nanometers to about 1 millimeter;

one or more aligning elements disposed in said enclosure, said device received within said enclosure responsive to said one or more aligning elements to align said one or more photoluminescent elements of said device with said one or more light emitting elements located in said enclosure;

a power source electrically coupled to said one or more light emitting elements; and a switch which upon an open condition of said enclosure to electrically uncouples said power source from said one or more light emitting elements.

* * * * *